US006115874A

United States Patent [19]

Camilleri et al.

[11] Patent Number: 6,115,874

[45] Date of Patent: Sep. 12, 2000

[54] ROUGHENER FOR GRIPS AND HANDLES

[76] Inventors: Paul Camilleri, R.R. #2, Head Chezzetcook, Halifax Co., Nova Scotia; W. M. Landymore, 526 West Lawrencetown Road, Lawrencetown, Nova Scotia, both of Canada

[21] Appl. No.: 09/212,400

[22] Filed: Dec. 16, 1998

[51] Int. Cl.[7] ..... A47L 13/02

[52] U.S. Cl. ..... 15/236.08; 15/104.04; 30/278

[58] Field of Search ..... 15/104.04, 236.02, 15/236.03, 236.05, 236.07, 236.08; 451/462; 30/278, 279.2

[56] References Cited

U.S. PATENT DOCUMENTS

| | | | |
|---|---|---|---|
| 647,676 | 4/1900 | Laverack | 15/104.04 |
| 790,228 | 5/1905 | Rohrer | 15/236.08 |
| 2,046,334 | 7/1936 | Loeber | 15/236.05 |
| 3,707,740 | 1/1973 | Demers | 15/236.03 |

FOREIGN PATENT DOCUMENTS

| | | | |
|---|---|---|---|
| 2023632 | 7/1991 | Canada . | |
| 2436697 | 5/1980 | France | 15/236.02 |

*Primary Examiner*—Randall E. Chin
*Attorney, Agent, or Firm*—Jones, Tullar & Cooper PC

[57] ABSTRACT

A device for roughening the worn or smooth grip of a golf club or other handled item includes a flat plate member with an aperture therethrough. A plurality of sharp-tipped serrations extend around the periphery of the aperture, with the tips defining a circular line that has a diameter greater than the maximum diameter of a grip at the free end thereof. Adjacent serrations define a valley therebetween. In use, the plate member is clamped in a bench vise and the grip, still affixed to its golf club, is moved through the serrated aperture with a radially directed force being applied thereto so that the serrations will cut a series of grooves into the material of the grip. Preferably the grip will be rotated and moved reciprocally through the serrated aperture so that a random pattern of grooves is cut into the grip, thereby restoring the grip to a condition that approximates its original textured surface. The device may include a set of transversely extending saw-tooth-like serrations along one transverse edge thereof for roughening the grips or handles of other handled items, including golf clubs.

5 Claims, 3 Drawing Sheets

ROUGHENER FOR GRIPS AND HANDLES

The present invention relates in general to an apparatus and method for roughening the surface of a handled item and in particular to an apparatus and method for improving the texture of a golf club grip. The invention is particularly useful in correcting the slipperiness of a golf club grip which, with use, becomes slippery.

BACKGROUND OF THE INVENTION

A golf club includes several components, namely a club head, a shaft, and a grip. While there are variations among the heads and the shafts in a set of clubs, there is commonality with the grips. Each club, with perhaps the exception of the putter, will have the same grip in a set of matched clubs. Different manufacturers produce different types of grips, some being made of leather and others being made of a synthetic material, such as a hard foam or rubber-like material. Some grips are have a fairly smooth surface while others have a more textured feel to them, whether the result of a pebbled surface or a grooved surface or a combination of both.

During the life of a set of clubs, which could be many years for the occasional golfer or one year or less for a professional golfer, one can expect the grips to wear and to become smoother and slippery with use. For most types of grips the wearing down of the surface texture could mean that the golfer will have more difficulty in maintaining his or her usual grip and this could affect the golfer's swing and the consistency of his or her game. There is a need for a device which can restore the texture or "feel" of a golf club grip so that the golfer is not forced to pay to have his clubs re-gripped whenever the grips in use become worn and inappropriately smoother than is desirable.

The problem above has been addressed for example in Canadian Patent Application No. 2,023,682 of John Kajfasz which was laid open to public inspection on Jul. 19, 1991. That application discloses an elongated element having therein a longitudinally extending semi-circular groove with an abrasive material such as sandpaper adhered to the surface of the groove. The device is rubbed along and around the grip so as to roughen the surface thereof. The sandpaper will eventually wear out and will have to be replaced. Also, the person using this device will have to experiment considerably in order to achieve an acceptable degree of roughness imparted to the grip. The device is large and is not something that the average golfer would want to carry in his golf bag; nor is it suitable for use by a golf club technician at a golf center or pro-shop, particularly because of the wear problem and the artistry required to use it properly. In addition, sandpaper is not always capable of creating the desired roughness of the grip. By its very nature, sandpaper is expected to smooth a surface, not to roughen it.

SUMMARY OF THE INVENTION

The present invention overcomes the problems associated with the above-identified Canadian patent application by providing a simple, easy to use, strong, and inexpensive roughening device for improving or restoring the texture of a golf club grip. The device of the present invention includes a strong and rigid plate member that is thin and small in size. The plate member has an aperture therethrough, which aperture has its periphery formed with a plurality of serrations of a generally saw-toothed shape. The diameter of the aperture as defined at the tips of the serrations or teeth is greater than the maximum diameter of a grip, usually at its free end. In use the grip is fed into the serrated aperture and forced against the tips of the serrations so that the sharp tips will cut into the material of the grip, creating small, narrow grooves therein. If the device and the grip are moved in random patterns relatively forwards and backwards and with a simultaneous rotating motion the grip will be roughened by the serrations so as to restore the texture of the grip.

An option for the invention would be a second serrated edge extending transversely of the device at one end thereof. Those serrations could also be used to roughen the grip, particularly towards the small diameter end of a grip.

Since the plate member of the invention is rigid it could be held in one's hand for roughening movement relative to the grip. Alternatively, the rigid plate member could be held in a bench vise, as in a repair shop, so that the user thereof need only hold the golf club and move it relative to the stationary roughener to restore the texture of the grip. With the device being used in this manner the user will have more control over the roughening process and the process can be accomplished quicker than if the device is held in one hand and the golf club in the other hand.

In summary therefore the present invention may be considered as providing a device for roughening a grip on a golf club, the device comprising a rigid plate member, an aperture extending through the plate member, and a plurality of adjacent serrations extending around the periphery of the aperture, with each serration having a sharp tip and with the diameter of the aperture at the tips of the serrations being greater than the maximum diameter of the grip.

DESCRIPTION OF THE PREFERRED EMBODIMENT

Figure 1:
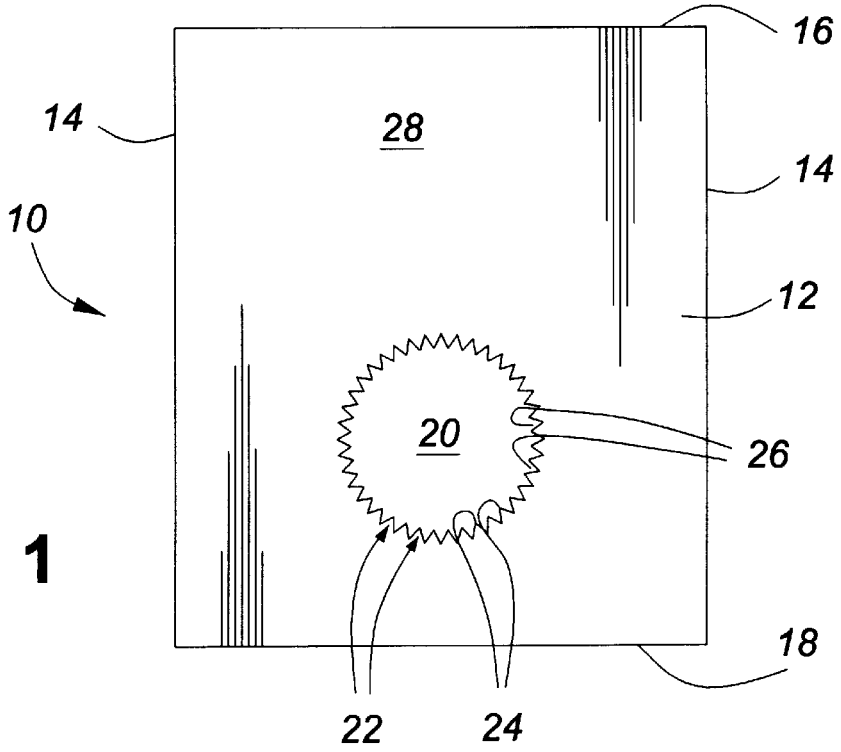
FIG. 1 is a front view of a golf club grip roughener in accordance with this invention.

FIG. 1 of the drawings shows a basic embodiment of the golf club grip roughener 10 of this invention. The device is shown as including a flat, generally rectangular, rigid plate member 12 having dimensions of approximately 90 cm by 75 cm and a thickness of about 0.3 cm. Preferably the material of the device is a high strength steel such as stainless steel. It could also be made from a hardened tool steel and plated to avoid rusting. Generally mid-way between the side edges 14, 14 of the plate member and positioned more towards one transverse edge 16 than the other transverse edge 18 is an aperture 20 which extends through the plate member. A plurality of saw-tooth-like serrations or teeth 22 extends around the periphery of the aperture, each tooth or serration 22 having a sharp tip 24 and adjacent serrations defining therebetween a valley 26. The tips 24 define a circular line having a diameter that is greater than the maximum diameter of a golf club grip. The flat face 28 of the plate member defines a clamping area that could also carry advertising or instructions on the use of the device, if desired.

Figure 2:
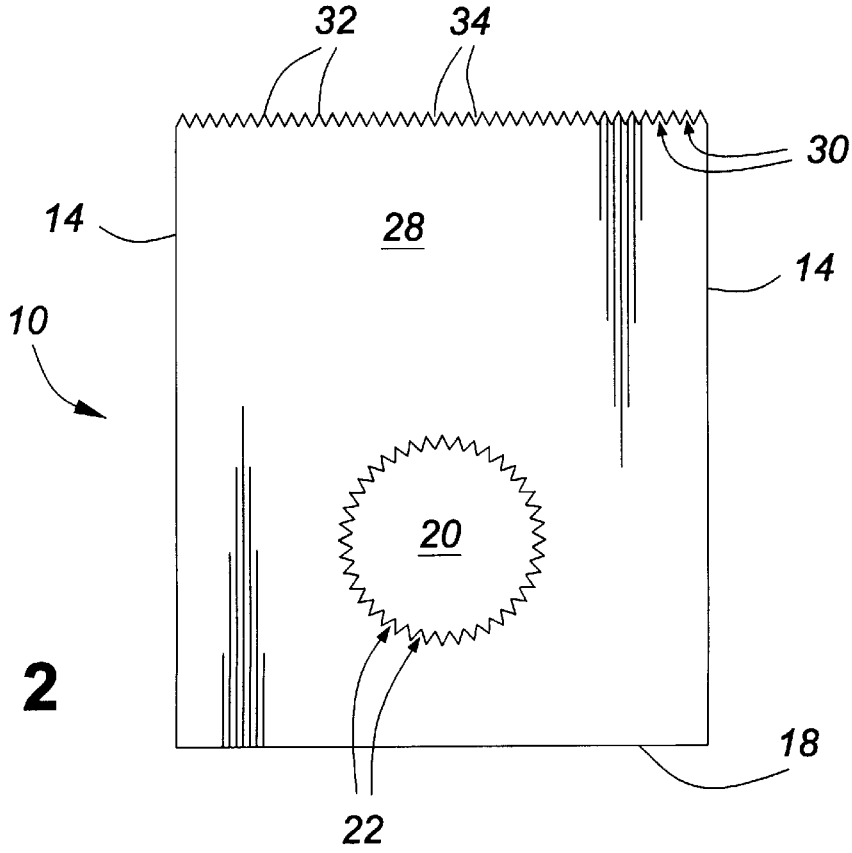
FIG. 2 is a front view of the roughener of FIG. 1 with an optional serrated edge thereon.

FIG. 2 shows a second embodiment of the invention wherein the transverse edge 16 also has a plurality of adjacent serrations 30 defining sharp tips 32 and valleys 34. The pitch of the serrations 30 can be the same as the pitch of the serrations 22 or the pitch can be different, perhaps similar to the separation between the grooves in the face of a golf club head.

Figure 3:
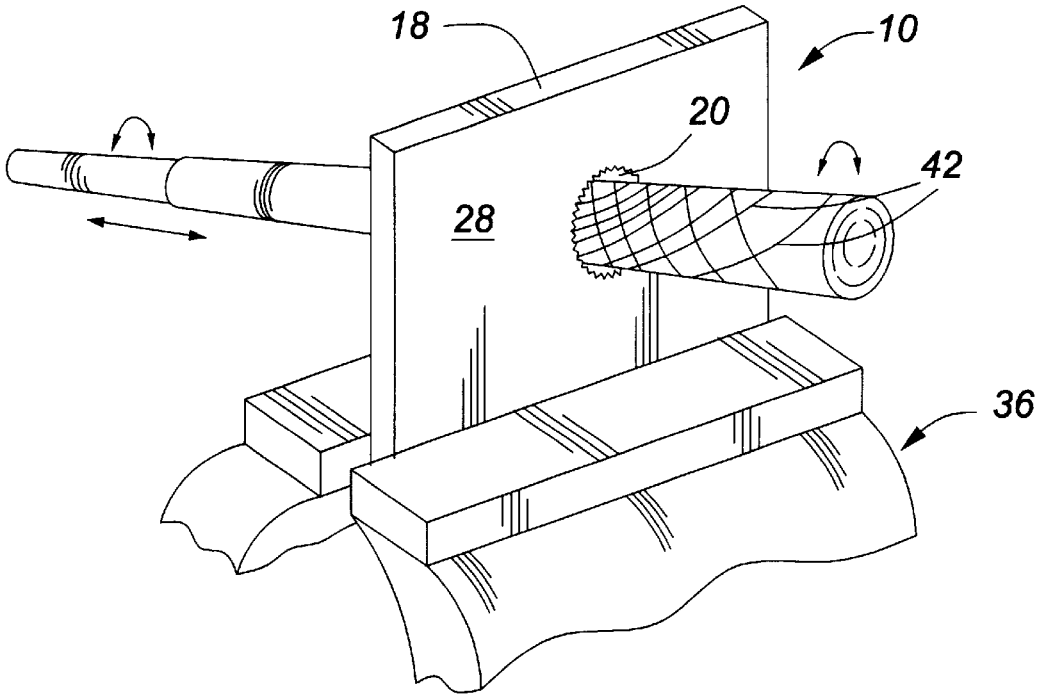
FIG. 3 is a perspective view showing the roughener of FIG. 2 in use.

FIG. 3 shows a roughener in accordance with FIG. 2 with the clamping area 28 being held in a bench vise 36 so that the serrated aperture 20 faces the operator. A golf club 38 having a grip 40 is reciprocatingly extended through the aperture 20 and a radially directed force, relative to the aperture, is applied to the grip so that the serrations bite or cut into the material of the grip therealong to create grooves or striations 42. If the grip is forced along a straight line through the aperture 20 then the grooves 42 will be parallel and will extend longitudinally of the grip. Since a golf club grip usually tapers along its length the operator will have to impart a continuous radial force on the grip in order to have the grooves extend along the full length of the grip. If the club is rotated as the grip is forced through the aperture 20 the grooves formed in the grip will take on a generally spiral or helical appearance. If the operator imparts a random combination of longitudinal and rotary motion to the club then the device of the invention will impart a random pattern of grooves in the grip, some of which will intersect other grooves and create a textured or roughened effect on the grip. Eventually the operator will create a roughened grip surface that generally mimics the original texture and will allow the golfer to enjoy his game with renewed vigor, knowing that his grips have been restored to a condition approaching their condition when new.

Figure 5:
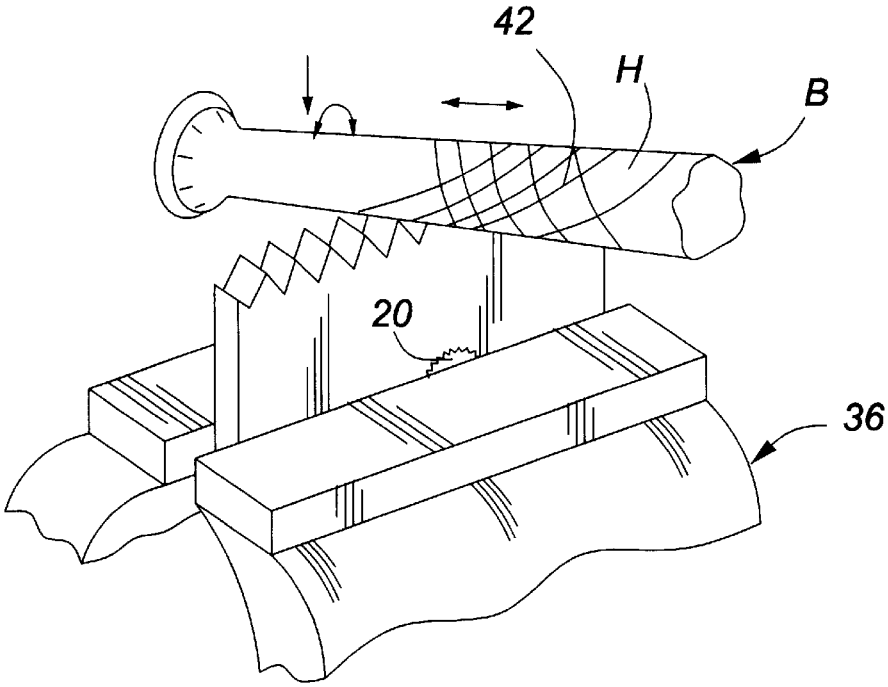
FIG. 5 is a perspective view of the roughener of this invention being used to roughen the handle of a baseball bat.

If the operator is using the device of FIG. 2 he can use the serrations 30 to roughen areas of a grip, such as the small diameter end, that might not have been roughened completely to the satisfaction of the operator or the golfer. The serrations 30 could also be used to clean the grooves commonly found in the face of a golf club head. Additionally, the serrations 30 could be used to roughen, as desired, a grip or handle on other types of handled items, such as tennis, badminton, squash and racketball rackets, baseball bats, hockey sticks, vault poles, relay batons, fishing rods, shovels, hoes, rakes, and lacrosse sticks to name a few. The roughened grip or handle on such items would improve the ability of the user to control the action of the item during use. FIG. 5 shows as an example a baseball bat B having its handle H being roughened by the serrations 30 of a roughener 10 held in a bench vise with a force being applied to the bat towards the serrations 30 as the bat is drawn across the serrations. The other items enumerated above could be roughened in the same manner or in the manner suggested below.

Although it is preferred that the device of this invention be used with a bench vise, so as to achieve maximum effectiveness with minimum effort, it should be borne in mind that it could be used without a vise, being held in one hand while the other hand holds the golf club or other item as mentioned above. The operator would move the device and the golf club or item relative to each other so as to achieve the same roughening effect on the grip as described hereinabove. A golfer might carry a device of the present invention in his or her golf bag so that he or she could roughen a grip as the necessity arises, without having to return the club or clubs to a professional operator.

Figure 4:
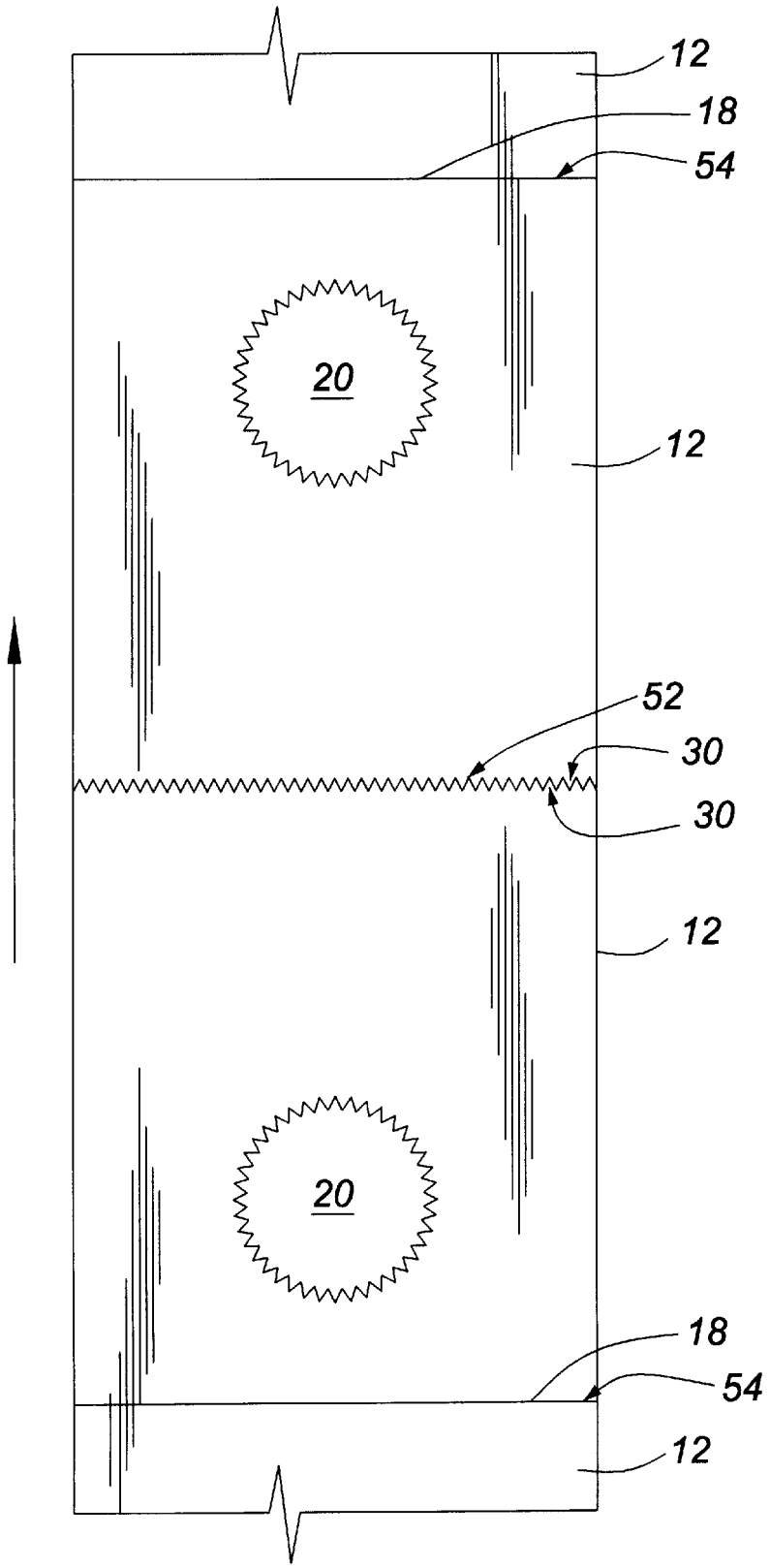
FIG. 4 is a plan view of a series of rougheners in accordance with the invention as they could be produced in a punch press from strip stock.

FIG. 4 of the drawings illustrates how successive rougheners of the invention might be made in a punch press from an elongated strip 50 of material. The strip 50 is fed into a press and pairs of plate members 12 are formed with their serrated edges 30 lying along a first common line 52. One of the pair of plate members is formed with its transverse edge 18 lying along another line 54 which is in common with the next plate member. By having the devices formed end to end in this manner a maximum economy of material achieved. Of course, the serrated aperture 20 will be formed in each plate member as the strip material passes through the punch press. Also, if rougheners are formed in accordance with the most basic embodiment of the invention the common lines 52 and 54 would both be straight and it would not matter whether the line 52, for example, represents edges 16 and 18 of successive plate members, or edges 16, 16 of successive plate members, or edges 18, 18 of successive plate members.

The foregoing has described the structure and operation of the golf club grip roughener of the present invention. While the preferred form of the invention has been presented it is understood that a skilled workman could modify the invention without departing from the spirit thereof. Accordingly the protection to be afforded this invention is to be determined from the scope of the claims appended hereto.

What is claimed is:

1. A device for roughening a grip on a golf club, comprising a generally rectangular flat plate member having a pair of parallel long edges and a pair of parallel transverse edges, an aperture extending through said plate member, said aperture being positioned closer to one of said transverse edges than to the other transverse edge so as to define a clamping area between the aperture and said other transverse edge, and a plurality of adjacent serrations extending around the periphery of said aperture, each said serration having a sharp tip and adjacent serrations defining a valley therebetween, the tips of said plurality of serrations defining a circular line having a diameter that is greater than the maximum diameter of a golf club grip.

2. The device of claim 1 wherein said one transverse edge is formed with a plurality of adjacent serrations extending therealong, each of said last-mentioned serrations having a sharp tip thereon.

3. A device for roughening a grip or a handle of a handled item, including that of a golf club, comprising: a flat plate member having a pair of parallel long edges, a pair of parallel transverse edges, and an aperture extending through said plate member and positioned closer to one of said transverse edges than to the other transverse edge so as to define a clamping area between the aperture and said other transverse edge; a plurality of adjacent serrations extending around the periphery of said aperture, each said serration having a sharp tip with adjacent serrations defining a valley therebetween, the tips of said plurality of serrations defining a circular line having a diameter that is greater than the maximum diameter of a golf club grip; and one of said transverse edges being formed with a plurality of adjacent serrations extending therealong, each of said last-mentioned serrations having a sharp tip thereon.

4. A method of roughening a grip of a golf club comprising the steps of providing a roughening device as defined in claim 1, clamping said device in a bench vise so that said aperture faces an operator, extending the golf club grip through said aperture, applying a radial force to the grip to bring it into forceful contact with said tips so that the sharp tips of said serrations cut into the material of said grip, and reciprocatingly moving said grip longitudinally through said aperture so that said tips will cut a series of grooves in said grip to roughen the surface thereof.

5. The method of claim 4 including the step of rotating said grip while it is being reciprocatingly moved through said aperture to impart a random pattern of cut grooves in the surface of said grip.

* * * * *